United States Patent [19]

Haderer et al.

[11] 4,260,650

[45] Apr. 7, 1981

[54] METERING DIE

[75] Inventors: Norman G. Haderer, Bristol; Robert D. Harris, Saltville, both of Va.

[73] Assignee: Westinghouse Electric Corp., Pittsburgh, Pa.

[21] Appl. No.: 954,384

[22] Filed: Oct. 25, 1978

[51] Int. Cl.[3] ..... B05D 3/06

[52] U.S. Cl. ..... 427/54.1; 118/122; 427/358

[58] Field of Search ..... 427/434 D, 54.1, 358, 427/356; 118/122, 121, 123, 125; 264/176 R

[56] References Cited

U.S. PATENT DOCUMENTS

| | | | |
|---|---|---|---|
| 2,346,697 | 4/1944 | Mungall | 118/125 |
| 2,774,684 | 12/1956 | Fucinari | 118/125 |
| 2,875,725 | 3/1959 | Lit et al. | 118/125 |
| 2,936,516 | 5/1960 | Adair | 427/434 D |
| 3,018,199 | 1/1962 | Lit et al. | 118/125 |
| 4,117,196 | 9/1978 | Mathias | 427/434 D |

*Primary Examiner*—John H. Newsome
*Attorney, Agent, or Firm*—R. D. Fuerle

[57] ABSTRACT

An improved metering die is disclosed which comprises two non-rotatable parallel metering pins, at least one of which is resiliently mounted for movement in opposition to the other. Means for adjusting the resiliency of the opposition is also provided.

A wire is immersed into a liquid resin and is passed through the metering die. The metering die removes excess resin and leaves a coating on the wire of precisely controlled thickness.

16 Claims, 2 Drawing Figures

METERING DIE

BACKGROUND OF THE INVENTION

In attempting to coat a thin strip of copper with a high viscosity resin it was found that conventional coating methods could not produce a uniform thin coating. Dip coating and the use of grooved pin-type dies depend upon a high degree of polymer flow before and during the curing process for control of the amount and uniformity of polymer deposition. High viscosity, high solids polymers do not have the flow characteristics needed for successful application by conventional methods. In the case of radiation-curable polymers, little flow occurs during cure so that if that application is not uniform, it does not flow out much during cure.

PRIOR ART

U.S. Pat. No. 2,774,684 to Fucinari discloses a method and apparatus for applying lubricants to sheet metal. After application of the lubricant the sheet metal is passed between rollers. Fluid pressure and an adjusting screw control the distance between the rollers.

SUMMARY OF THE INVENTION

We have invented an adjustable liquid polymer metering die which effectively controls the amount of polymer deposited on a wire as well as the uniformity of the deposition. While the die works with any type of resin it is especially suited for use with high solids resins as it results in better edge coverage than other techniques do. Even though high viscosity resins are used, 100% pinhole-free coverage can be achieved.

DESCRIPTION OF THE INVENTION

Figure 2:
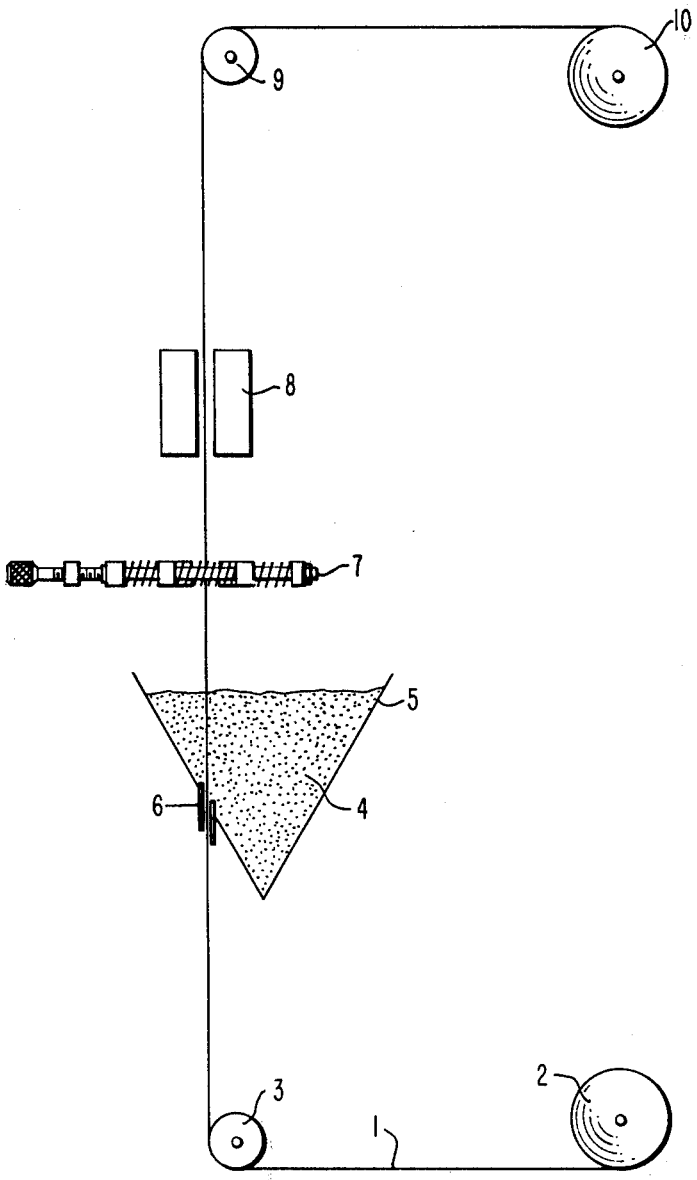
FIG. 2 is a diagrammatic side view showing the use of a metering die according to this invention in a system for coating and curing a wire with a liquid resin.

In FIG. 2, wire 1 is drawn from pay-off reel 2 over sheeve 3 and through liquid resin 4 in applicator pod 5. A polytetrafluoroethylene (Teflon) seal 6 prevents resin from leaking out of applicator pod 5. The wire then proceeds through metering die 7 which removes excess resin and spreads the resin uniformly over the wire. The wire passes through curing system 8 (UV lamps for a UV-curable resin), which solidifies the resin before it goes over sheeve 9 onto take-up reel 10.

Figure 1:
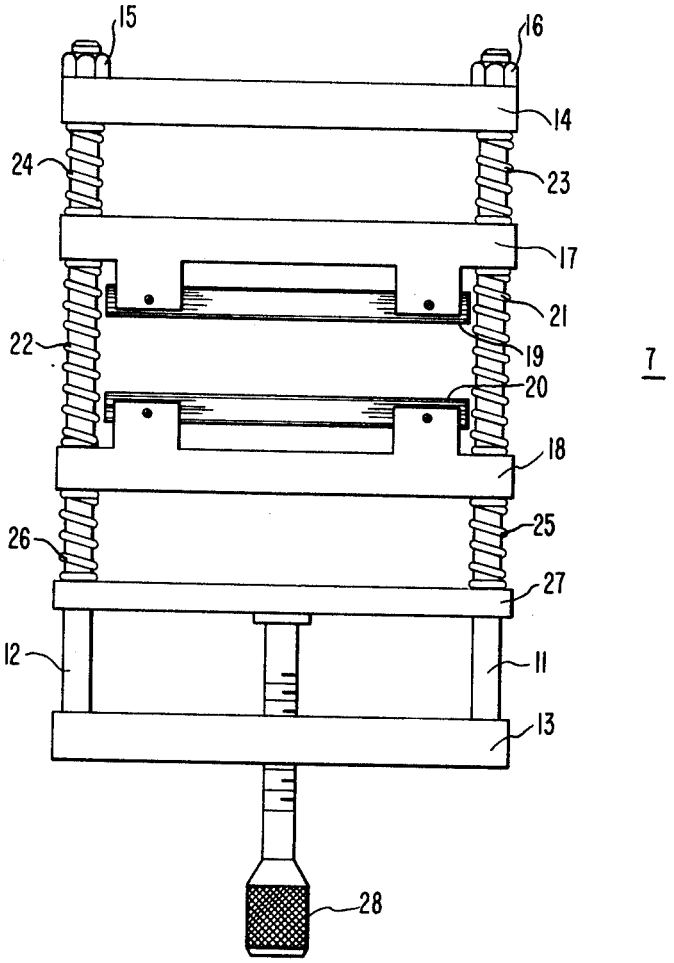
FIG. 1 is a diagrammatic side view of a certain presently preferred embodiment of a metering die according to this invention.

FIG. 1 reveals the details of metering die 7. In FIG. 1, the metering die consists of two parallel guide pins 11 and 12 held fixed in retainers 13 and 14 by lock nuts 15 and 16. Mounted perpendicular to guide pins 11 and 12 are two pin holders 17 and 18 which can slide along the guide pins. Each pin holder holds a fixed metering pin 19 and 20 between which the wire passes. Springs 21 and 22 force the metering pins apart and springs 23, 24, 25, and 26 force them together. A pressure bar 27 is also mounted perpendicularly on guide pins 11 and 12 and can slide along the guide pins. A micrometer pressure adjustment 28 is threaded into retainer 13 so that turning micrometer pressure adjustment 28 controls the position of pressure bar 27 and therefore the compression of springs 21 to 26. The metering die permits the metering pins to move together in the same direction when the position of the wire changes. The metering pins can also move in opposite directions when the wire varies in thickness. The metering pins may be of any shape necessary to conform to the cross-sectional geometry of the wire. The round metering pins shown in the drawing are especially suitable for flat wire. Edge coverage seems to be self-regulating. The metering pins are preferably made of Teflon, but may be of nylon, metal, or other suitable material. In most applications the micrometer pressure adjustment is tightened so that the metering pins press against the wire.

It should be noted that although the drawings show the preferred embodiment various alterations may be made in the metering die shown in the drawing. The springs between the metering pins can be eliminated although they are preferably present as they give a finer adjustment on the amount of build and they allow freedom of movement of the metering pin. Of course, the outside springs could be in extension instead of in compression though still mounted so as to force the metering pins together. One set of outside springs could be eliminated too, but this is likely to produce poorer coatings. The apparatus is preferably arranged so that the wire is aligned with the center of the opening between the metering pins when no wire is present so that the pressure on both sides of the wire is equal, if an equally thick coating is desired on each side, although lack of precison in this respect is not critical. Finally, other methods of adjusting the compression of the springs may be used, and resilient elastomers or the like could be used instead of springs.

The resin used is preferably an ultraviolet high solids resin as the metering die works very well with such resins. Also, a UV-curable resin uses less energy during cure and can be made 100% solids. The resin is preferably high (60 to 100%) solids as high solids resins give better edge coverage. Polyene resins are preferred because they can be 100% solids and UV-curable.

We claim:

1. An improved metering die comprising (1) two parallel rigid supports;

(2) two parallel metering pins at least one of which is slidably mounted across said two parallel rigid support;

(3) resilient means forcing said slidably mounted metering pin to move towards the other;

(4) resilient means forcing said slidably mounted metering pin to move away from the other; and (5) means for adjusting the degree of force exerted by said resilent means.

2. An improved metering die according to claim 1 wherein both of said two parallel metering pins are slidably mounted across said two parallel rigid supports, including resilient means for moving each of said slidably mounted metering pins towards the other.

3. An improved metering die according to claim 2 wherein said resilient means are springs in compression.

4. An improved metering die according to claim 1 wherein said means for adjusting the degree of force exerted by said resilient means is a micrometer screw which adjusts the compression of said resilient means.

5. An improved metering die comprising (1) a fixed frame;

(2) two non-rotatable parallel metering pins, each mounted on said fixed frame;

(3) said metering pins being in resilient relationship to each other and to said fixed frame.

6. An improved metering die according to claim 5, including means for adjusting the resiliency of said resilient means.

7. An improved metering die according to claim 5 wherein said resilient means is a set of springs interposed between each metering pin and said fixed frame, and between said metering pins themselves.

8. An improved metering die according to claim 5 wherein said springs are in compression.

9. An improved metering die according to claim 5 wherein said metering pins are made of polytetrafluoroethylene.

10. An improved metering die according to claim 5 including means for centering a moving wire between said metering pins.

11. An improved metering die according to claim 10 wherein said wire moves vertically upward between said metering pins.

12. An improved metering die according to claim 5 wherein said metering pins are circular in cross section.

13. A method of preparing a wire coated with a resin of precisely controlled thickness comprising (A) immersing said wire into a liquid resin;

(B) pulling said wire through a metering die according to claim 5 to remove excess resin therefrom; and (C) curing said resin coating.

14. A method according to claim 13 wherein said resin is a UV-cured 100% solids polyene resin.

15. A method according to claim 13 including means for adjusting the resiliency of said resilient means.

16. A method according to claim 13 wherein said wire is a strip.

* * * * *